US009121613B2

(12) United States Patent
Carnell, Jr. et al.

(10) Patent No.: US 9,121,613 B2
(45) Date of Patent: Sep. 1, 2015

(54) COMBUSTOR WITH BRIEF QUENCH ZONE WITH SLOTS

(75) Inventors: William Francis Carnell, Jr., Greer, SC (US); Gregory Allen Boardman, Greer, SC (US)

(73) Assignee: General Electric Company, Schenectady, NY (US)

( * ) Notice: Subject to any disclaimer, the term of this patent is extended or adjusted under 35 U.S.C. 154(b) by 588 days.

(21) Appl. No.: 13/488,466

(22) Filed: Jun. 5, 2012

(65) Prior Publication Data

US 2013/0318992 A1 Dec. 5, 2013

(51) Int. Cl.

| | |
|---|---|
| ***F02C 3/20*** | (2006.01) |
| ***F23R 3/14*** | (2006.01) |
| ***F23R 3/42*** | (2006.01) |
| *F23R 3/12* | (2006.01) |
| *F23R 3/30* | (2006.01) |
| *F23R 3/58* | (2006.01) |

(52) U.S. Cl.

CPC ..... *F23R 3/42* (2013.01); *F23R 2900/00015* (2013.01)

(58) Field of Classification Search

CPC ..... F23R 3/02; F23R 3/12; F23R 3/14; F23R 2900/00015; F23R 3/30; F23R 3/58; F23R 3/286

USPC ..... 60/748, 752–760, 804, 746, 740, 749, 60/39.463

See application file for complete search history.

(56) References Cited

U.S. PATENT DOCUMENTS

| | | | | |
|---|---|---|---|---|
| 3,430,443 | A * | 3/1969 | Parnell et al. | 60/738 |
| 3,906,718 | A * | 9/1975 | Wood | 60/738 |
| 4,249,373 | A * | 2/1981 | Sotheran et al. | 60/804 |
| 4,474,014 | A * | 10/1984 | Markowski | 60/738 |
| 4,719,748 | A | 1/1988 | Davis, Jr. et al. | |
| 4,893,475 | A * | 1/1990 | Willis | 60/732 |
| 4,984,429 | A | 1/1991 | Waslo et al. | |
| 5,026,273 | A * | 6/1991 | Cornelison | 431/170 |
| 6,155,819 | A * | 12/2000 | Etemad et al. | 431/228 |
| 6,735,949 | B1 | 5/2004 | Haynes et al. | |
| 6,951,108 | B2 | 10/2005 | Burrus et al. | |
| 7,003,961 | B2 | 2/2006 | Kendrick et al. | |
| 7,080,515 | B2 | 7/2006 | Wasif et al. | |
| 7,340,881 | B2 | 3/2008 | Koganezawa et al. | |
| 7,506,512 | B2 | 3/2009 | Schumacher et al. | |
| 7,966,822 | B2 | 6/2011 | Myers et al. | |
| 2004/0020211 | A1 | 2/2004 | Kendrick et al. | |
| 2004/0103663 | A1 * | 6/2004 | Haynes et al. | 60/737 |
| 2004/0112039 | A1 | 6/2004 | Koganezawa et al. | |
| 2006/0042255 | A1 * | 3/2006 | Bunker et al. | 60/752 |

(Continued)

OTHER PUBLICATIONS

U.S. Appl. No. 13/367,686, Feb. 7, 2012, Boardman, et al.

*Primary Examiner* — Phutthiwat Wongwian
*Assistant Examiner* — Eric Linderman
(74) *Attorney, Agent, or Firm* — Sutherland Asbill & Brennan LLP

(57) ABSTRACT

The present application provides a combustor for combusting a number of flows of air and a number of flows of fuel. The combustor may include a central swirler for producing a high swirl quench air flow, a number of trapped vortex cavities surrounding the central swirler for producing a flow of combustion gases, a brief severe quench zone downstream of the trapped vortex cavities to quench the flow of combustion gases between an outer quench air flow and the high swirl quench air flow, and an expansion zone downstream of the brief severe quench zone.

15 Claims, 3 Drawing Sheets

(56) References Cited

U.S. PATENT DOCUMENTS

| | | | | |
|---|---|---|---|---|
| 2008/0271703 | A1* | 11/2008 | Armstrong et al. | 123/263 |
| 2009/0019854 | A1 | 1/2009 | Simons et al. | |
| 2010/0003128 | A1 | 1/2010 | Chila et al. | |
| 2010/0018211 | A1 | 1/2010 | Venkataraman et al. | |
| 2010/0034643 | A1 | 2/2010 | Davis, Jr. et al. | |
| 2010/0037620 | A1 | 2/2010 | Chila | |
| 2010/0205972 | A1* | 8/2010 | Chila et al. | 60/752 |
| 2010/0223931 | A1* | 9/2010 | Chila et al. | 60/760 |
| 2011/0061391 | A1 | 3/2011 | Kendrick | |
| 2011/0061392 | A1* | 3/2011 | Kendrick | 60/737 |
| 2011/0162378 | A1 | 7/2011 | Chila et al. | |
| 2012/0216542 | A1* | 8/2012 | Siden et al. | 60/772 |
| 2012/0240592 | A1* | 9/2012 | Keny et al. | 60/776 |
| 2013/0199188 | A1* | 8/2013 | Boardman et al. | 60/737 |
| 2013/0291548 | A1* | 11/2013 | Ingram et al. | 60/772 |
| 2013/0327057 | A1* | 12/2013 | Cunha et al. | 60/782 |
| 2014/0109581 | A1* | 4/2014 | Dudebout et al. | 60/732 |

* cited by examiner

COMBUSTOR WITH BRIEF QUENCH ZONE WITH SLOTS

TECHNICAL FIELD

The present application and the resultant patent relate generally to gas turbine engines and more particularly relate to a gas turbine engine having a combustor with a brief severe quench zone for the combustion of liquid fuels such as those high in fuel bound nitrogen, gas fuels, and the like so as to provide low temperature combustion and limit undesirable emissions.

BACKGROUND OF THE INVENTION

Operational efficiency in a gas turbine engine generally increases as the temperature of the combustion stream increases. Higher combustion stream temperatures, however, may result in the production of high levels of nitrogen oxides ($NO_x$) and other types of undesirable emissions. Such emissions may be subject to both federal and state regulations in the United States and also may be subject to similar regulations abroad. Moreover, financing of gas turbine engines and power plants often may be subject to international emissions standards. A balancing act thus exists between operating a gas turbine engine within an efficient temperature range while also ensuring that the output of nitrogen oxides and other types of regulated emissions remain well below mandated levels. Many other types of operational parameters also may be varied in providing such an optimized balance.

Operators of gas turbine engines and the like may prefer to use different types of fuels depending upon availability and price. For example, liquid fuels such as heavy fuel oil may be available. Heavy fuel oil, however, may have a high level of conversion to nitrogen oxides above certain temperatures. Specifically, liquid fuels such as heavy fuel oil may be high in fuel bound nitrogen. As a result, such fuels may need the use of selective catalytic reduction and the like to reduce the level of emissions. Such processes, however, add to the overall operating costs and the overall complexity of the gas turbine engine.

There is thus a desire for a combustor capable of efficiently combusting various fuels including liquid fuels high in fuel bound nitrogen such as heavy fuel oil and the like. Preferably, such a combustor may combust such fuels at lower temperatures to maintain overall emissions compliance.

SUMMARY OF THE INVENTION

The present application and the resultant patent thus provide a combustor for combusting a number of flows of air and a number of flows of fuel. The combustor may include a central swirler for producing a high swirl quench air flow, a number of trapped vortex cavities surrounding the central swirler for producing a flow of combustion gases, a brief severe quench zone downstream of the trapped vortex cavities to quench the flow of combustion gases between an outer quench air flow and the high swirl quench air flow, and an expansion zone downstream of the brief severe quench zone.

The present application and the resultant patent further provide a method of combusting a flow of air and a flow of fuel in a combustor. The method may include the steps of combusting in part the flow of fuel and the flow of air in a trapped vortex cavity for a low temperature rich combustion, quenching the low temperature rich combustion in a brief severe quench zone into rich combustion products, and combusting the rich combustion products in an expansion zone for a low temperature lean combustion.

The present application and the resultant patent further provide a combustor for combusting a number of flows of air and a number of flows of fuel. The combustor may include a central swirler for producing a high swirl quench air flow, a number of trapped vortex cavities surrounding the central swirler for producing a flow of combustion gases, and a brief severe quench zone downstream of the trapped vortex cavities. The brief severe quench zone may include a number of quench air injectors and a number of slots therein for producing an outer quench air flow so as to quench the flow of combustion gases between the outer quench air flow and the high swirl quench air flow.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
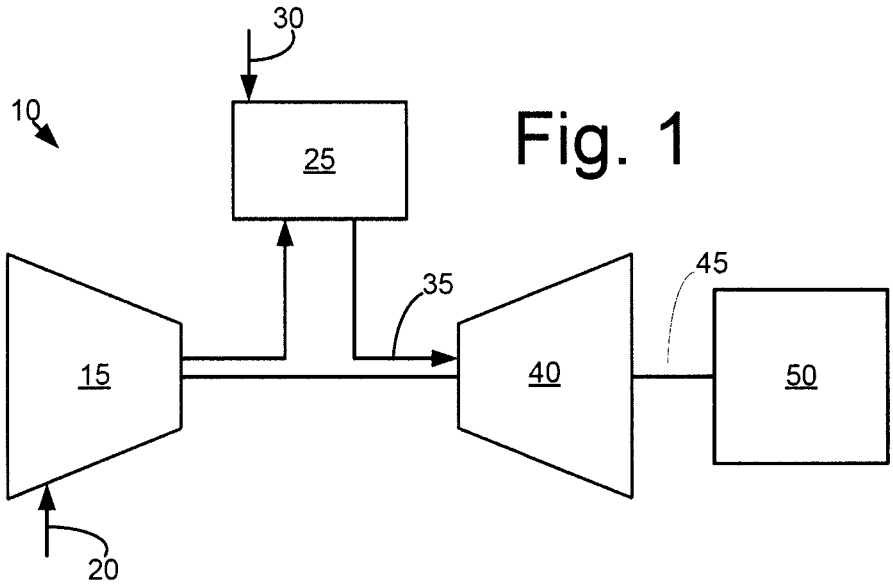
FIG. 1 is a schematic diagram of a gas turbine engine having a compressor, a combustor, and a turbine.

Referring now to the drawings, in which like numerals refer to like elements throughout the several views, FIG. 1 shows a schematic diagram of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The combustor 25 of the gas turbine engine 10 may use natural gas, liquid fuels, various types of syngas, and/or other types of fuels. The gas turbine engine 10 may be any one of a number of different gas turbine engines offered by General Electric Company of Schenectady, New York, including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
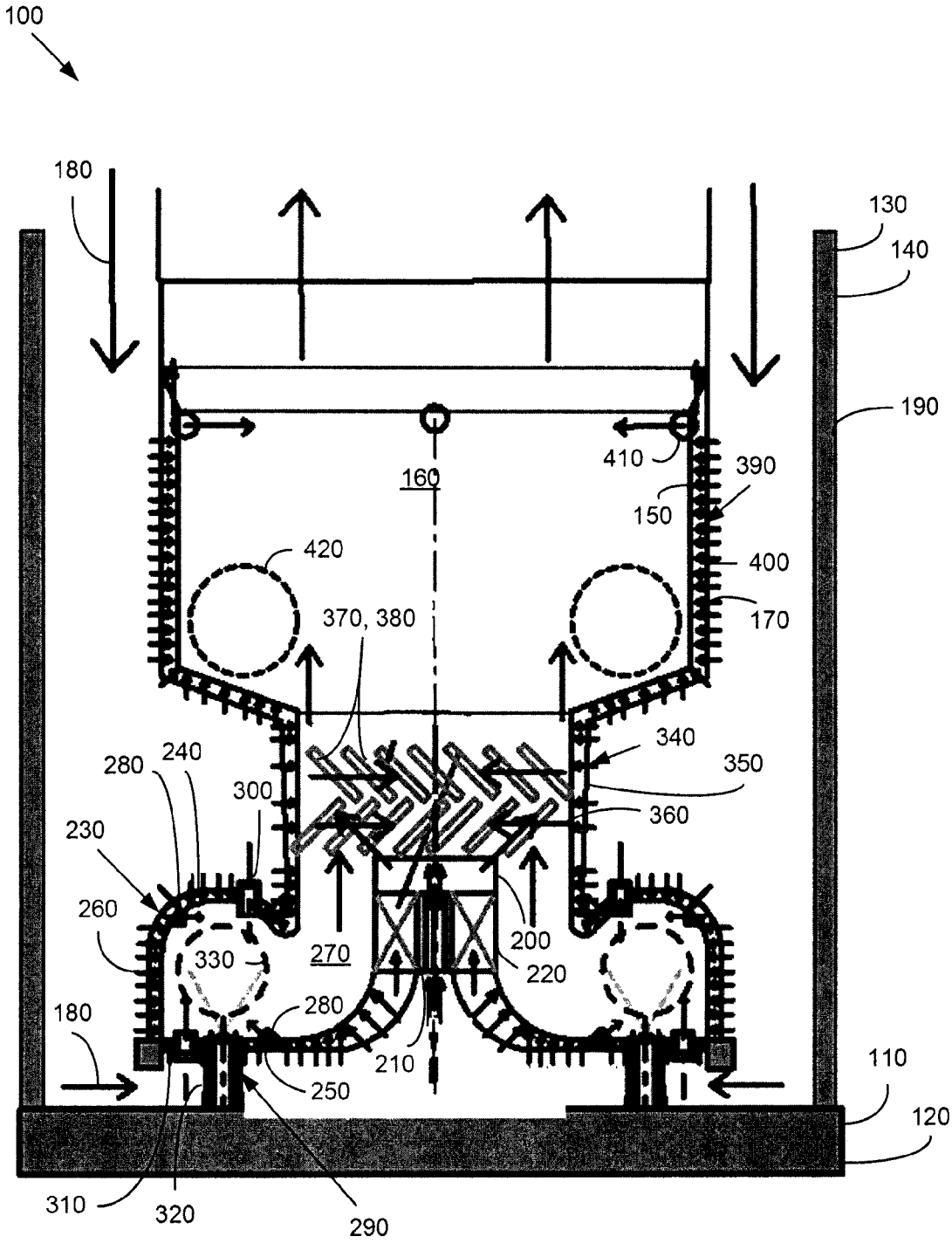
FIG. 2 is a schematic diagram of a combustor for a gas turbine engine as may be described herein.

FIG. 2 shows an example of a combustor 100 as may be described herein. The combustor 100 may be used in the gas turbine engine 10 described above and the like. The combustor 100 may extend from an end cover 110 at a head end 120 to a transition piece 130 at an aft end 140 adjacent to the turbine 40. A liner 150 may extend from the head end 120 towards the aft end 140. The liner 150 may define a combustion zone 160 therein. The liner 150 may be surrounded by an impingement sleeve 170 and the like. The impingement sleeve 170 provides impingement cooling to the liner 150. A flow path 180 may be in communication with the impingement sleeve 170. The flow path 180 may provide the flow of air 20 from the compressor 15 or elsewhere for cooling and combustion. The combustor 100 may be enclosed by a casing 190 from the head end 120 to the aft end 140. Other components and other configurations also may be used herein.

The combustor 100 may include a central jet 200. The central jet 200 may extend from the end cover 110. The central jet 200 may include a central air injector 210 in communication with the flow of air 20. The central air injector 210 may be surrounded by a swirler 220. The swirler 220 may have any size, shape, or configuration. The swirler 220 injects swirl into the flow of air 20 extending from the flow path 180 to form a high swirl quench flow 225. Other components and other configurations may be used herein.

The combustor 100 also may include one or more trapped vortex cavities 230. The trapped vortex cavities 230 may be positioned about the head end 120 and may surround the central jet 200 in whole or in part. Each trapped vortex cavity 230 may be defined by an annular aft wall 240, an annular forward wall 250, and a radial outer wall 260. The trapped vortex cavity 230 also may have a cavity opening 270 leading towards the central jet 200. The trapped vortex cavity 230 may include a number of thimble jets or air injectors 280 for driving the captured recirculation flow. The trapped vortex cavity 230 also may include one or more forward wall fuel injectors 290 and/or one or more aft wall fuel injectors 300. In this example, the forward wall fuel injectors 290 may include one or more gas fuel injectors 310 and/or one or more liquid fuel injectors 320. The number and position of the air injectors 280 and the fuel injectors 290, 300 may vary. Other components and other configurations also may be used herein.

The air injectors 280 and the fuel injectors 290, 300 of the trapped vortex cavity may be configured to drive a vortex 330 therein. The flows of air 20 and fuel 30 mix and combust to form the flow of combustion gases 35. The combustion gases 35 expand and extend through the cavity opening 270 in the trapped vortex cavity 230 towards the central jet 200. Other components and other configurations may be used herein.

Figure 3:
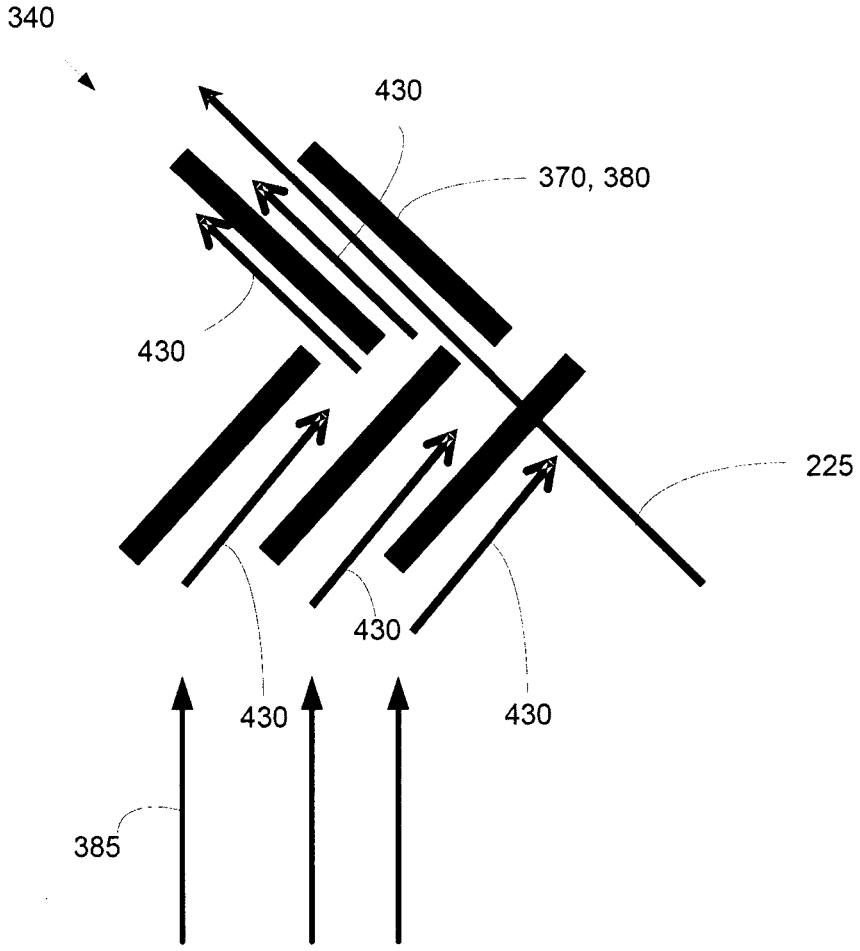
FIG. 3 is a schematic diagram of a portion of a brief severe quench zone of the combustor of FIG. 2.

A brief severe quench zone 340 may be positioned downstream of the central jet 200 and the trapped vortex cavities 230. The brief severe quench zone 340 may be defined by a constricted shape 350 of the liner 150. A number of quench air injectors 360 may surround the brief severe quench zone 340 for a flow of air 20 therein. The brief severe quench zone 340 also may have a number of slots 370 or other types of shaped holes formed therein. The slots 370 may have a substantial herringbone-like pattern 380. Many other different shapes may be used herein. The number, size, shape, and orientation of the slots 370 may vary. The flow of air 20 along the slots 370 thus may form an outside quench flow 385. As is shown in FIG. 3, the slots 370 impact on the high swirl quench flow 225 injected via the swirler 230 of the central jet 200. Other components and other configurations may be used herein.

The combustor 100 may include an expansion zone 390 downstream of the brief severe quench zone 340. The expansion zone 390 may have an expanded shape 400 of the liner 150 for a larger flow area. The expansion zone 390 may be substantially axis-symmetric in shape. The expansion zone 390 may extend towards the transition piece 130. A number of dilution/trim jets 410 may be used herein. One or more lean recirculation zones 420 may be formed therein for lean combustion stabilization. Other components and other configurations also may be used herein.

In use, the combustor 100 may be impingement cooled via the flow of air 20 cooling the liner 150 via the impingement sleeve 170. The flow of air 20 extending along the flow path 180 thus may be preheated therein. The flow of air 20 may be admitted into the trapped vortex cavities 230 via the air injectors 280. Likewise, the flow of fuel 30 may be admitted into the trapped vortex cavity 230 via the forward fuel injectors 290 and the aft wall fuel injectors 320. The gas fuel injectors 310 and/or the liquid fuel injectors 320 may be used. The trapped vortex cavity 230 thus forms the vortex 330 therein. The trapped vortex cavity 230 provides sufficient residence time for the substantially complete vaporization of the liquid fuel as well as the appropriate mixing and stoichiometry for low temperature rich combustion, i.e., an equivalence ratio of greater than about 1.5 or so. Specifically, the trapped vortex cavity 230 provides stable, rich combustion at low temperatures.

The combustion gases 35 then flow into the brief severe quench zone 340. The quench flows 225, 385 provided in the brief severe quench zone 340 may be of a sufficiently high strain rate and intensity so as to cause extinction of the flame of the combustion gases 35. Specifically, the brief severe quench zone 340 sandwiches a flow of rich combustion products 430 from the trapped vortex cavities 230 between the outer quench flow 385 from the quench air injectors 360 via the slots 370 and the herringbone pattern 380 and the high swirl quench flow 225 from the swirler 220 of the central jet 200. The intensity and strain of the quench flows 225, 385 thus prevent high temperature combustion while rapidly mixing for lean burning downstream in the expansion zone 390. The expanded shape 400 of the expansion zone 390 downstream of the brief severe quench zone 340 then provides stabilization and lean combustion, i.e., an equivalence ratio of less than about 0.49 or so at relatively low temperatures. Other components and other configurations also may be used herein.

The use of the brief severe quench zone 340 in the combustor 100 described herein provides a low nitrogen oxide solution for the combustion of liquid fuels high in fuel bound nitrogen such as heavy fuel oil and the like. The quench flows 225, 385 of the brief severe quench zone 340 thus permits low temperature combustion with low emissions without the need for catalysts and the like.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A combustor for combusting a number of flows of air and a number of flows of fuel, comprising:

a central swirler for producing a high swirl quench air flow;

a plurality of trapped vortex cavities surrounding the central swirler for producing a flow of combustion gases, such that an aft end wall of each of the plurality of trapped vortex cavities at least partially overlaps with the central swirler;

a brief severe quench zone comprising a liner with a constricted shape downstream of the plurality of trapped vortex cavities to quench the flow of combustion gases between an outer quench air flow and the high swirl quench air flow, wherein the high swirl quench air flow and the flow of combustion gases are delivered to the constricted shape of the brief severe quench zone, wherein the brief severe quench zone comprises a plurality of slots therein, the plurality of slots comprising a herringbone-like pattern, such that alternating rows of the plurality of slots are positioned in different directions so as to form a V shape; and an expansion zone downstream of the brief severe quench zone.

2. The combustor of claim 1, wherein the liner has an expanded shape about the expansion zone.

3. The combustor of claim 1, wherein the plurality of trapped vortex cavities comprises a plurality of air injectors.

4. The combustor of claim 1, wherein the plurality of trapped vortex cavities comprises a plurality of fuel injectors.

5. The combustor of claim 4, wherein the plurality of fuel injectors comprises an aft wall fuel injector or a forward wall fuel injector.

6. The combustor of claim 4, wherein the plurality of fuel injectors comprises a gas fuel injector and a liquid fuel injector.

7. The combustor of claim 1, wherein each of the plurality of trapped vortex cavities creates a fuel/air vortex therein.

8. The combustor of claim 1, wherein the brief severe quench zone comprises a plurality of quench air injectors to provide the outer quench air flow.

9. The combustor of claim 1, wherein the expansion zone comprises one or more lean recirculation zones therein.

10. The combustor of claim 1, further comprising a transition piece downstream of the expansion zone.

11. The combustor of claim 1, further comprising an impingement cooled liner.

12. A method of combusting a flow of air and a flow of fuel in a combustor, comprising:

combusting in part the flow of fuel and the flow of air in a trapped vortex cavity for a low temperature rich combustion, wherein the trapped vortex cavity surrounds a central swirler such that an aft end wall at least partially overlaps with the central swirler;

quenching the low temperature rich combustion in a brief severe quench zone into rich combustion products, wherein the brief severe quench zone comprises a liner with a constricted shape downstream of the trapped vortex cavity, and a plurality of slots comprising a herringbone-like pattern, such that alternating rows of the plurality of slots are positioned in different directions so as to form a V shape; and combusting the rich combustion products in an expansion zone downstream of the brief severe quench zone for a low temperature lean combustion.

13. A combustor for combusting a number of flows of air and a number of flows of fuel, comprising:

a central swirler for producing a high swirl quench air flow;

a plurality of trapped vortex cavities surrounding the central swirler for producing a flow of combustion gases, such that an aft end wall of each of the plurality of trapped vortex cavities at least partially overlaps with the central swirler; and a brief severe quench zone comprising a liner with a constricted shape downstream of the plurality of trapped vortex cavities, wherein the high swirl quench air flow and the flow of combustion gases are delivered to the constricted shape of the brief severe quench zone;

the brief severe quench zone comprising a plurality of quench air injectors and a plurality of slots therein for producing an outer quench air flow so as to quench the flow of combustion gases between the outer quench air flow and the high swirl quench air flow, wherein the plurality of slots comprises a herringbone-like pattern, such that alternating rows of the plurality of slots are positioned in different directions so as to form a V shape.

14. The combustor of claim 13, further comprising an expansion zone with an expanded shape downstream of the brief severe quench zone.

15. The combustor of claim 13, wherein the plurality of trapped vortex cavities comprises a gas fuel injector and a liquid fuel injector.

* * * * *